US006359568B1

(12) United States Patent
Johnson

(10) Patent No.: US 6,359,568 B1
(45) Date of Patent: Mar. 19, 2002

(54) PERSONAL RESCUE DEVICE

(76) Inventor: Harry Calvin Johnson, 116 River Dr., Panacea, FL (US) 32346

( * ) Notice: Subject to any disclaimer, the term of this patent is extended or adjusted under 35 U.S.C. 154(b) by 0 days.

(21) Appl. No.: 09/444,094

(22) Filed: Nov. 22, 1999

Related U.S. Application Data

(60) Provisional application No. 60/109,478, filed on Nov. 23, 1998.

(51) Int. Cl.[7] ..... G08B 3/00

(52) U.S. Cl. ..... 340/691.7; 116/210; 116/DIG. 8; 116/DIG. 9; 340/573.1

(58) Field of Search ..... 340/691.7, 573.1; 116/210, DIG. 9, DIG. 8

(56) References Cited

U.S. PATENT DOCUMENTS 5,005,513 A 4/1991 Van Patten et al. ..... 116/210
5,199,374 A * 4/1993 Blanchette ..... 116/210 X
5,582,127 A 12/1996 Willis et al. ..... 116/210
5,945,912 A * 8/1999 Guldbrand ..... 340/573.1

* cited by examiner

*Primary Examiner*—Thomas Mullen
(74) *Attorney, Agent, or Firm*—Carnes Cona & Dixon

(57) ABSTRACT

The present invention is a rescue device including a casing having a hollow interior area. The casing includes an opened top and enclosed bottom. Removably secured to the opened top is a lid. Located within the casing is a gas cylinder, having a gas that is lighter than air. This gas cylinder is coupled to a collapsible and inflatable balloon. A sensing mechanism is coupled to a valve. This valve is coupled to the gas cylinder. Once a change in the electrical potential is detected via the sensing mechanism, it triggers the valve. This will cause the valve to open and hence allow for the gas to enter and fill the balloon. During the inflation process, the balloon expands and inherently causes the top to be lifted and remove for allowing the balloon to float and travel upwards. The balloon is maintained to the device via a tether.

17 Claims, 3 Drawing Sheets

PERSONAL RESCUE DEVICE

This is a Utility Patent Application for Provisionally Filed Application No. 60/109,478 filed on Nov. 23, 1998.

BACKGROUND OF THE INVENTION

1. Field of the Invention

The present invention relates generally to a compact and personal rescue device and more particularly to a rescue device which is versatile by providing a device which is not only suited for use on ground, but can be activated automatically when submerged in water. Thereby, providing a device that is not only suited for campers, hikers, mountain climbers and other who enjoy the outdoors, but is also adaptable to those who are water enthusiasts, such as boaters, fishermen, divers, or the like, and for those who work on or near the water, such as military personnel, passengers and employees on aircraft and/or cruise ships, or the like.

2. Description of the Prior Art

Rescue devices are known in the art and are generally designed and configured to include a housing that protects and houses a helium cartridge and inflatable balloon. In this arrangement, when needed, the helium cartridge is activated and thus enables the balloon to be inflated and visible to a rescue party.

Such a device is disclosed in U.S. Pat. No. 5,582,127 issued to Willis et al. and in U.S. Pat. No. 5,005,513 issued to Van Patten et al. In both of these patents there is disclosed an inflatable balloon housed within a compact housing. A helium cylinder is used to inflate the balloon to enable its visibility and to alert that someone is in need of assistance. Though successful in inflating a balloon, these patents, like the other conventional rescue devices do suffer some shortcomings. One shortcoming is that there is no safety mechanism to prevent the balloon from accidentally inflating. An accidental inflation of the balloon can be burdensome to the party and even difficult to correct. Yet another problem associated with these conventional devices and with the ones identified above, is that there is no means of activation when and if the housing were to be submerged in water, inherently prohibiting the use to strictly land and not water. Such a restriction limits its versatility and usability.

Accordingly, it is seen that there exists a need of improving personal rescue devices, so as to provide for a versatile and durable device that is not prone to accidental activation. Such a device should be user friendly and one that can easily and quickly be activated in the course of an emergency. In addition, the personal rescue device should be able to activate upon the detection of water, so as to enable activation of a warning means once it is submerged in water. In essence, what is needed is a device which can not only mechanically be activated, but can be activated automatically. Such a device can operate and function successfully even if an individual is unconscious and will inherently aid a rescue party in locating people needing assistance and for those who may have unfortunately lost their lives.

The previous personal rescue devices, as identified above, fail to provide the benefits intended with the present invention, such as providing a versatile unit, which can be used successfully on ground and in the water, and one which cannot be activated accidentally. As seen, prior techniques and devices do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention is a personal emergency location device designed and configured to operate successfully on ground as well as if submerged in water. Such an apparatus is versatile and is ideally suited in any environment and is adaptable to any situation, regardless if on ground or in water.

The personal emergency location device comprises a casing having a hollow interior area and an opened top. Secured to the opened top is a removable end cap. Located within the casing is an inflatable balloon that is coupled to a cylinder. The cylinder houses pressurized gas that is lighter than air, such as helium. Situated between the cylinder and balloon is an actuation value. A mechanical activation device is secured to the actuation valve and extends out to the exterior of the casing. This mechanical activation device enables the valve to open and permit the balloon to inflate. Affixed to the balloon and casing is a tether. When inflated, the tether will maintain the balloon to the casing in order to prevent the balloon from escaping.

To prevent the activation device from accidentally opening or activating the actuation valve, a safety is secured thereto. This safety is a prevention measure, which locks the activation device in a fixed position and prevents accidental triggering of the cylinder.

An automated activating device is also provided and is ideally suited for use should the casing be submerged in water. This second or automatic activating device is controlled electrically and hence includes a power source, such as a battery, which is coupled to a control circuit. A sensor device is coupled to the control circuit and once water is detected via the sensor device, the control circuit activates the actuation valve. Activation will cause the valve to open, and hence enable the balloon to be filled with a gas that is lighter than air. Upon being filled with a gas that is lighter than air, such as helium, the balloon inherently expands and forces the cap off the casing. The balloon then inflates and travels upwards. It is secured to the casing via the tether.

The balloon can have any shape; design, color or configuration, such as being round or have verbiage indicating assistance is needed. However in a preferred embodiment, the balloon includes a unique design and shape which has proven to be more visual. This balloon includes a top portion and a lower portion. The top portion includes a pyramid shape that is structured for optimal reflection and detection, especially visual from aircraft flying at low altitude. The lower portion is rectangular in shape and structured for maximum reflectivity from low flying helicopters and aircraft as well as being visual via surface vessels, such as motor vehicles or water vessels. Preferably, the material used for the balloon is aluminized Mylar or the like.

Accordingly, it is the object of the present invention to provide for an emergency location device which will overcome the deficiencies, shortcomings, and drawbacks of prior personal emergency location device and methods thereof.

Still another object of the present invention is to provide for an emergency location device which is suitable for use on land and which will automatically be activated when submerged in water, inherently providing a device which is suited for use on or in proximity of water.

Yet another object of the present invention, to be specifically enumerated herein, is to provide an emergency location device in accordance with the preceding objects and which will conform to conventional forms of manufacture, be of simple construction and easy to use so as to provide a device that would be economically feasible, long lasting and relatively trouble free in operation.

Although there have been many inventions related to a emergency location devices, none of the inventions have become sufficiently compact, low cost, useable in and around water, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
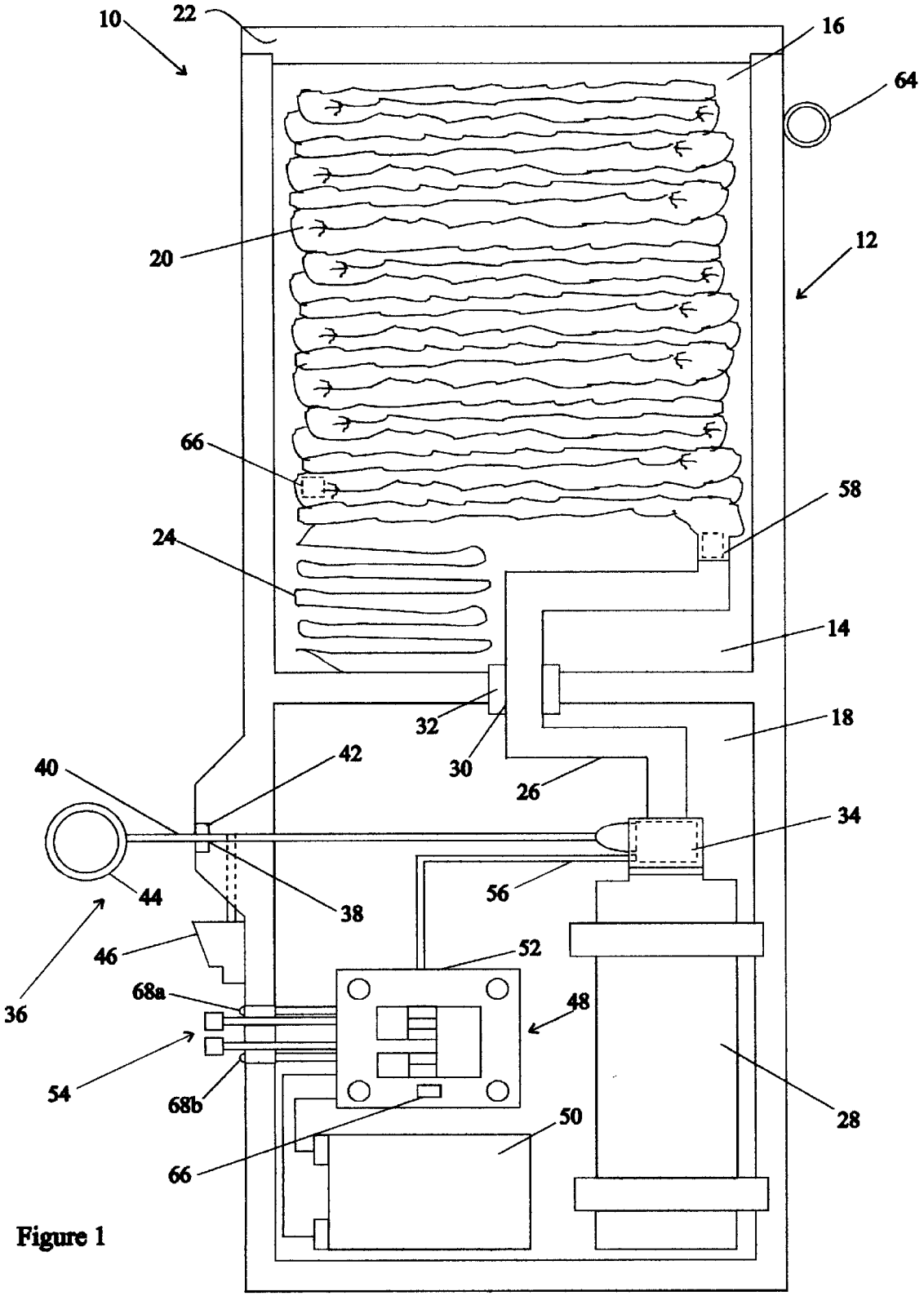
FIG. 1 is a cross-sectional view of the emergency location device of the present invention.

As seen through the various views of the drawings, in particular FIGS. 1–3, the present invention which is an emergency location device will be described. As seen in the drawings, the emergency location device 10 comprises a hollow casing 12 having an upper portion 14, with an open top 16, and a lower portion 18. The upper portion 14 houses and maintains the inflatable balloon 20. When stored within the casing 12, the balloon is in a collapsed stage. This upper portion 14 is sealed from the lower portion 18 to provide for the lower portion to be waterproof as well as weatherproof. Removably secured to the upper portion, at the open top 16, is a removable lid 22. This lid provides for the balloon to be sealed within the upper portion 14 of the casing 12. During the inflating process, the balloon will force the lid 22 off the upper portion 14 for exposing the open top 16 and enable the balloon to exit therefrom.

A tether 24 secures the balloon 20 to the lower portion 18 of the casing 12. As seen in the drawings, the first end of the tether is secured to the balloon, while the second end is secured to the lower surface of the upper portion. This tether 24 can extend into the interior area of the lower portion, if desired.

Tubing 26 is used to couple the inflatable balloon to a cylinder 28, which includes pressurized, lighter than air gas, such as helium. The cylinder 28 is maintained to the casing via brackets (illustrated, but not labeled). As seen in the various drawings, this tubing extends from the lower portion 18 to the upper portion 14. An opening 30 is located between the two portions of the casing, and a seal, gasket or O-ring 32 can surround the tubing 26 for rendering a waterproof and weather proof seal between the two portions of the casing 12.

Located within the tubing 26 and coupled to the cylinder 28 is an actuation valve 34 (illustrated in outline). The actuation valve is an electrical/mechanical valve that is also known as a servo mechanism or servo valve. In essence, this type of valve can be activated either mechanically or electrically.

A mechanical activation device 36 is secured to the actuation valve 34 and extends out to the exterior of the casing 12 via an opening 38. This opening allows for the activating device, which is generally a cord 40 or the like to extend through the opening 38. To retain a waterproof environment for the lower portion 18 of the casing, this opening will include a gasket, seal, or O-ring 42. Located at the opposite end of the cord is a handle 44. This design and configuration of the mechanical activation device 34 provides for a pull type device so as to allow for the user to pull the handle for opening the actuation valve 34.

To prevent the activation device from accidentally opening or activating the actuation valve, a safety 46 is secured to the mechanical activation device 36. This safety 46 is a conventional mechanism and it locks the cord in a fixed position so as to prohibit pulling of the cord. This will prevent the mechanical activation device from accidentally opening or activating the actuation valve.

An automated activating device or electrical activating device 48 is also provided and is ideally suited for use should the casing 12 be submerged in water. This electrical or automatic activating device is controlled electrically and hence includes a power source 50, such as a battery, which is coupled to a control circuit 52. A sensor device 54 is coupled to the control circuit 52 and extends out and to the exterior of the casing. The sensing device extends through the casing 12 via apertures (illustrated, but not labeled). To prevent water or the like from entering the casing, gaskets, seals, O-rings or the like are used (illustrated, but not labeled). This sensing device is designed to detect water, mud or the like. Once water is detected via the sensor device, the control circuit activates the actuation valve. Activation will cause the actuation valve 34 to open, and hence enable the balloon to be filled with the desired gas, such as helium.

Figure 2:
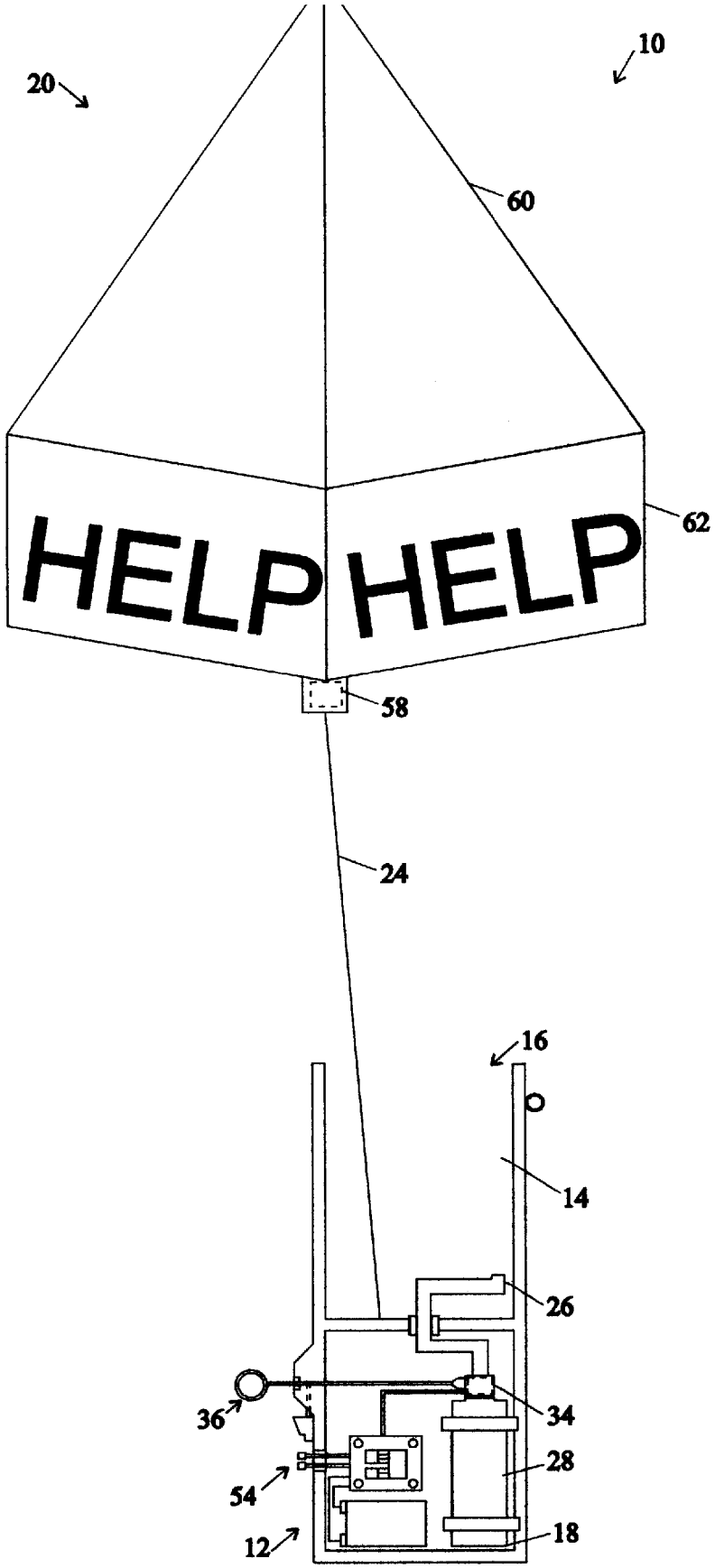
FIG. 2 is a cross-sectional view of the casing of the emergency location device and the balloon being employed and inflated during use.

In a preferred embodiment, the sensor device comprises a pair of terminals, as shown in FIGS. 1 and 2. Once a potential changes between the two terminals, such as if the device is submerged in water, a signal is sent to the control circuit 52 for activation. The signal will activate a timer on the control circuit 52, and after a pre-determined amount of time, such as within three minutes, the signal is sent to the actuation valve 34 via electrical lines 56. This will enable the valve to electrically open and enable the balloon to fill with the desired gas, such as helium.

Upon being filled with the desired gas, the balloon inherently expands and forces the cap 22 off the casing 12. The balloon then inflates and travels upwards. The balloon does not fly away or escape from the casing since it is secured to the upper or lower portion via the tether 24.

Other conventional features can be coupled to the device for enhancing the rescue device of the present invention.

One feature that can be added is the use of a warning device 68*a* for warning the individual if the batteries are low. A warning device 68*b* can also be provided to indicate if the gas cylinder is not an adequate amount for filling the helium balloon.

The balloon can have any shape, design, color or configuration, such as being round, cylindrical and can include verbiage indicating assistance is needed, such as the terms "HELP", "SOS", or the like, as illustrated in FIG. 2, but not labeled. The inlet of the balloon 20 must have a check valve 58 (illustrated in outline) internally secured thereto. This check valve 58 is conventional and is also known as a one-way valve. The use of a check valve will prevent the gas from escaping from the balloon 20 as it is being filled, thereby enabling flow to occur in one direction.

Figure 3:
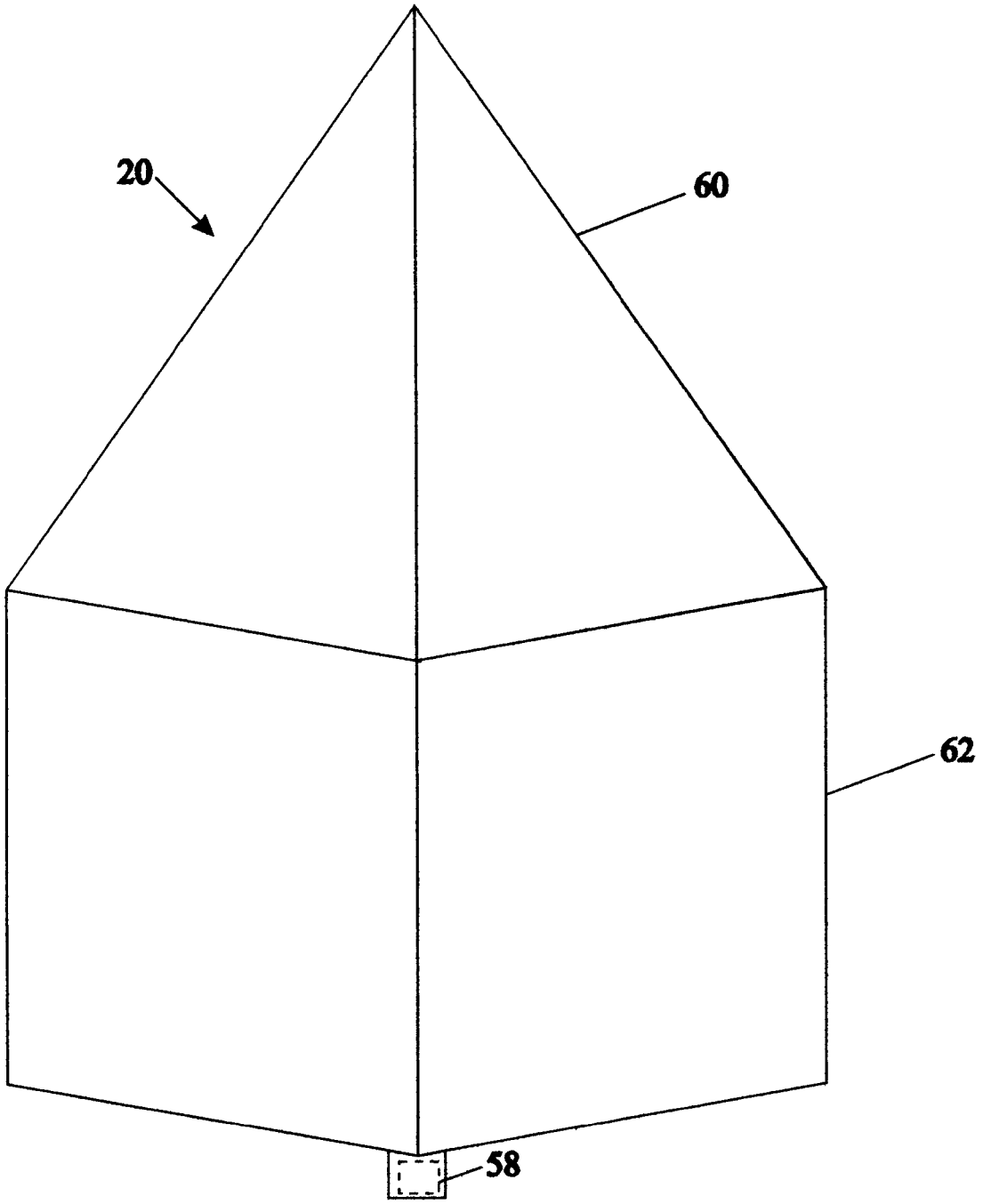
FIG. 3 is an enlarged view of the preferred embodiment of the balloon used for the emergency location device of the present invention.

In a preferred embodiment, and as seen in FIGS. 2 and 3, the balloon 20 includes a unique design and shape that has proven to be more visual. This balloon 20 includes a top portion 60 and a lower portion 62. The top portion 60 includes a pyramid shape that is structured for optimal reflection and detection, especially visual from aircraft flying at low altitude. The lower portion 62 is rectangular in shape and structured for maximum reflectivity from low flying helicopters and aircraft as well as being visual via surface vessels, such as motor vehicles or water vessels. Preferably, the material used for the balloon is aluminized Mylar or the like. Optionally, the balloon can be fabricated from or coated with a material, which possesses highly reflective material or even has a neon color. This will provide for a final product which is clearly visual by including a radar reflective shape which is used to aid in location of the items or individuals in need of assistance.

To further assist in the location of individuals or to locate an area of a recent accident, such as a plane wreck, regardless of the weather or time of day, a conventional tracking device 66 can be located on the control circuit 52 and/or internally secured to the balloon. The actuation valve will be electrically coupled to this tracking device so as to enable a signal to be sent for activation of the unit once the actuation valve is activated. Upon activation, the tracking device will give off an appropriate signal that can be detected by radar. Such a mechanism would further enhance the product.

The exterior of the casing 12 can include a conventional carrying means 64. This conventional carrying means will aid and assist the individual to carry the personal locator device 10 of the present invention. The conventional carrying means can be any one, or a combination of any type or style of carrying means, such as, but not limited to a strap, clip, key chain device, or the like.

While the invention has been particularly shown and described with reference to an embodiment thereof, it will be understood by those skilled in the art that various changes in form and detail may be made without departing from the spirit and scope of the invention.

What is claimed is:

1. A rescue apparatus comprising:

a hollow casing having an open top and an enclosed bottom;

a removable lid is secured to said open top;

a sensor mechanism is stored within said casing;

said sensor mechanism senses alterations in electrical potential;

a cylinder storing gas that is lighter than air is located within said hollow casing;

a collapsible balloon is stored within said hollow casing;

a valve couples said cylinder to said balloon;

an electrical activation device couples said sensor to said valve;

a mechanical activation mechanism is coupled to said valve for enabling said rescue apparatus to be activated manually if desired; and for automatic activation, once a change or alteration in electrical potential is detected via said sensor mechanism, said sensor mechanism activates said valve via said electrical activation device, said valve opens and enables gas to flow from said gas cylinder to said balloon, wherein as said balloon inflates, it forces said lid off of said casing and enables said balloon to float, and for manual activation, said mechanical activation mechanism is activated for enabling said valve to open permitting gas to flow from said gas cylinder to said balloon, wherein as said balloon inflates, it forces said lid off of said casing and enables said balloon to float.

2. A rescue device as in claim 1 wherein said balloon is secured to said casing via a tether.

3. A rescue device as in claim 1 wherein said gas is helium.

4. A rescue device as in claim 1 wherein said valve is a check valve.

5. A rescue device as in claim 1 wherein said sensor is powered via batteries.

6. A rescue device as in claim 5 wherein a warning device is coupled to said sensor for activating a warning mechanism once said batteries are low.

7. A rescue device as in claim 1 wherein a warning device is coupled to said gas cylinder for activating a warning mechanism once said chamber is low on gas.

8. A rescue device as in claim 1 wherein a carrying mechanism is secured to said casing for enabling said casing to be carried by an individual.

9. A rescue device as in claim 1 wherein a safety is secured to said mechanical activation mechanism for preventing accidental activating of said valve.

10. A rescue device as in claim 1 wherein a tracking device is secured within said casing.

11. A rescue device as in claim 1 wherein a tracking device is secured within said balloon.

12. A rescue device as in claim 1 wherein a check valve is located within said balloon for preventing said gas from escaping once located therein.

13. A rescue device as in claim 1 wherein said balloon includes a top portion and a lower portion, said top portion is pyramidal in shape and said lower portion is cubical in shape.

14. A rescue device as in claim 1 wherein said balloon is fabricated from a material possessing reflective characteristics.

15. A rescue device as in claim 1 wherein said balloon includes indicia located thereon for indicating assistance is needed.

16. A rescue device as in claim 1 wherein said casing is waterproof.

17. A rescue device as in claim 1 wherein said mechanical activation mechanism is a pull cord.

* * * * *